US010000894B1

(12) United States Patent
Schlenker et al.

(10) Patent No.: US 10,000,894 B1
(45) Date of Patent: Jun. 19, 2018

(54) SPRAY BAR ASSEMBLY FOR MACHINE SYSTEM, AND METHOD

(71) Applicant: Caterpillar Paving Products Inc., Brooklyn Park, MN (US)

(72) Inventors: Brian Schlenker, Shoreview, MN (US); Matthew Stoner, Savage, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days. days.

(21) Appl. No.: 15/707,248

(22) Filed: Sep. 18, 2017

(51) Int. Cl.

| | |
|---|---|
| ***E01C 19/00*** | (2006.01) |
| ***E01C 19/17*** | (2006.01) |
| ***E01C 23/088*** | (2006.01) |
| ***E01C 23/06*** | (2006.01) |

(52) U.S. Cl.
CPC ..... *E01C 19/176* (2013.01); *E01C 23/065* (2013.01); *E01C 23/088* (2013.01)

(58) Field of Classification Search
CPC ..... E01C 19/176; E01C 23/065; E01C 23/088
USPC ..... 404/72, 92, 101, 111
See application file for complete search history.

(56) References Cited

U.S. PATENT DOCUMENTS

| | | | | |
|---|---|---|---|---|
| 4,786,111 | A * | 11/1988 | Yargici | B28D 1/188 299/10 |
| 9,598,825 | B2 | 3/2017 | Menzenbach et al. | |
| 2012/0043401 | A1 | 2/2012 | Heusinger et al. | |
| 2017/0314214 | A1* | 11/2017 | Christian | E01C 19/176 |
| 2018/0030676 | A1* | 2/2018 | Menzenbach | E01C 23/088 |

* cited by examiner

*Primary Examiner* — Raymond W Addie
(74) *Attorney, Agent, or Firm* — Mattingly, Burke, Cohen & Biederman, LLP

(57) ABSTRACT

A spray bar assembly in a material working system of a ground-engaging machine, such as a rotary mixer, includes a spray bar coupled with an elongate carrier by way of a hinge connector. The elongate carrier is supported between guides mounted upon a housing of a rotor in the material working system, to guide the spray bar assembly for linear movement relative to a frame of the ground-engaging machine. The elongate carrier has openings that register with spray ports in a housing of the system, and the spray bar is tiltable to position spray nozzles within the openings and spray ports or withdraw the spray nozzles from the openings and spray ports.

20 Claims, 5 Drawing Sheets

SPRAY BAR ASSEMBLY FOR MACHINE SYSTEM, AND METHOD

TECHNICAL FIELD

The present disclosure relates generally to material working systems in ground-engaging machines, and more particularly to a spray bar assembly in a material working system that is movable according to multiple degrees of freedom for spray nozzle access and servicing.

BACKGROUND

Machines equipped with various implements such as tractors, pavers, graders, scrapers and still others are used for modifying substrate material or preparing a substrate for various end uses. In the paving and road building contexts, machines known as cold planers are used to remove previously deposited paving material in preparation for placement of a substitute paving material mat. A cold planer is typically equipped with a rotor that breaks paving material into chunks of manageable size, and conveys the removed paving material to a truck for disposal or other use such as fill.

In recent decades, there has been increased interest in in situ processing and reuse of paving material. Most persons will be familiar with cracked, uneven, and/or potholed road and parking lot surfaces. The economy of reusing paving material in place, without removing it and transporting it elsewhere, should be readily apparent. Machines known as recyclers, mixers, or reclaimers are in increasing use throughout the world for preparing substrates to support a new traffic-bearing paving material mat. Such machines break apart old paving material and mix the chunks of paving material with underlying material such as soil, to produce a prepared substrate for placement of a new traffic-bearing surface such as a road, parking lot, airstrip, et cetera. Achieving a desired composition of the mixed material once processed has proven to be challenging. Moreover, it is often desirable to mix additives, typically in a liquid form, into the mixed soil and broken-apart paving material. The paving material that is reclaimed can vary in composition, physical state such as hardness, aggregate size or content, extent of cracks, bumps, or other features. For these and other reasons, controlling the rotor speed, rotor depth, machine speed, and application of additives, can require design and operational capabilities of the machine that are relatively complex. U.S. Pat. No. 8,794,869 to Schlenker et al. is directed to an exemplary rotary mixer having a rotor chamber with a rotor therein. An electronic control module adjusts a degree of pulverization of reclaimed surface to achieve a desired end result. The relatively harsh operating conditions experienced by the machine shown in Schlenker et al., and other analogous machines, generally requires that machine components be regularly serviced. In complex machines such as a rotary mixer or the like, accessing different valves, bearings, electronics, pumps, sprayers, motors, and still other types of on-board equipment for servicing can be challenging.

SUMMARY OF THE INVENTION

In one aspect, a spray bar assembly for a ground-engaging machine includes a spray bar having a fluid inlet formed therein, and a plurality of spray nozzles in fluid communication with the fluid inlet. The spray bar assembly further includes a hinge connector defining a hinge axis, and an elongate carrier coupled to the spray bar by way of the hinge connector and extending in longitudinal alignment with the spray bar. The elongate carrier has a forward support element and a back support element for supporting the elongate carrier between guide elements mounted to the ground-engaging machine, such that the spray bar assembly is guided for linear movement relative to the ground-engaging machine. The elongate carrier further has at least one opening formed therein between the forward support element and the back support element, and the spray bar is rotatable about the hinge axis relative to the elongate carrier between a tilted position, and an operating position, and the plurality of spray nozzles each extend through the at least one opening at the operating position.

In another aspect, a machine system includes a housing positionable about a material working mechanism of a ground-engaging machine. The housing has an inner surface, and an outer surface extending fore to aft between a leading edge and a trailing edge, and laterally between a left lateral edge and a right lateral edge. The machine system further includes a spray bar assembly mounted to the housing and including a spray bar having a fluid inlet structured to connect with a fluid reservoir, and an elongate carrier coupled to the spray bar, the elongate carrier supporting the spray bar and configured to allow the spray bar to move linearly relative to the housing. The spray bar includes a plurality of spray nozzles in fluid communication with the fluid inlet. The housing further has a plurality of spray ports formed therein extending between the outer surface and the inner surface, and the spray bar is movable between a disengaged position to allow linear movement of the spray bar relative to the housing, and an operating position at which the plurality of spray nozzles are aligned with the plurality of spray ports.

In still another aspect, a method of operating a spray bar assembly for a ground-engaging machine includes rotating a spray bar between an operating position and a tilted position relative to an elongate carrier coupled to the spray bar by way of a hinge connector, and moving a plurality of spray nozzles of the spray bar between a first orientation at the operating position, where the plurality of spray nozzles are in fluid communication with the material working chamber in the ground-engaging machine, and a second orientation at the tilted position. The method further includes sliding the spray bar and elongate carrier laterally with respect to the ground-engaging machine between an inboard position where the plurality of spray nozzles are positioned inboard of lateral edges of the housing forming a material working chamber, and a lateral stop position where at least some of the plurality of spray nozzles are positioned outboard of the housing.

DETAILED DESCRIPTION

Figure 1:
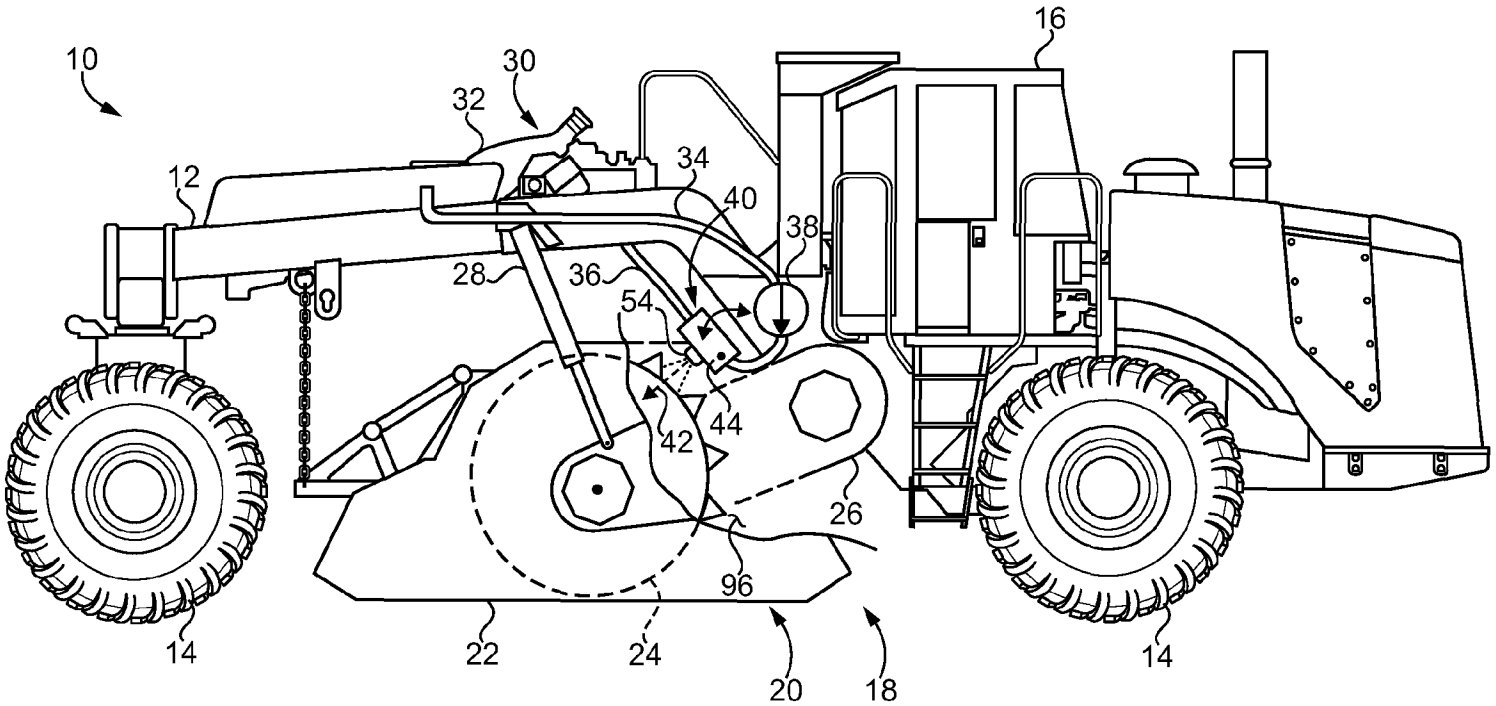
FIG. 1 is a partially open, side diagrammatic view of a machine, according to one embodiment.

Referring to FIG. 1, there is shown a machine 10 according to one embodiment, and including a machine frame 12 having an operator cab 16 mounted thereon, and a plurality of ground-engaging elements 14. Machine 10 includes a material working system 18, such as for road reclaiming, the features and operation of which are further discussed herein. Machine 10 is shown in the context of a rotary mixer or reclaimer, where material working system 18 includes a material working mechanism 20 having a rotor 24 supported within a housing 22. Rotor 24 can include a toothed rotor 24 that is suspended below machine frame 12, and supported by way of a lift arm 26, typically one lift arm on each lateral side of housing 22, and adjustable by way of one or more lift actuators 28. Those skilled in the art will be familiar with adjusting a height/depth of a rotor to vary a working depth of a material working mechanism such as material working mechanism 20. For roading operation, material working mechanism 20 can be lifted above an underlying substrate. When reclaiming, material working mechanism 20 can be lowered below an upper surface of the substrate such that rotor 24 cuts at a range of cutting depths. Although machine 10 is shown as a wheeled, self-propelled machine that is manually operated, it should be appreciated that the present disclosure is not thereby limited. Pushed devices, towed devices, a track-type machine construction, autonomous machines, and still other variations on the presently disclosed embodiments are contemplated within the present context.

Machine 10 also includes a machine system 30 for applying liquid additives to the material being worked by material working mechanism 20. Those skilled in the art will be familiar with liquid asphalt-based emulsions, water-based additives, hydrocarbon additives, and still other fluid additives that can be applied to paving material and soil mixtures to prepare a substrate for purposes of road reclaiming. Machine system 30 can include a fluid reservoir 32 mounted upon frame 12 to contain a liquid additive to be applied. Fluid reservoir 32 need not necessarily be mounted on machine 10, however. A supply line 34 extends from fluid reservoir 32 to a pump 38, and a return line 36 extends back to fluid reservoir 32. Machine system 30 also includes a spray bar assembly 40 positioned fluidly between pump 38 and fluid reservoir 32. Spray bar assembly 40 can be mounted to a housing 22 of material working mechanism 20, and as shown in FIG. 1 is oriented such that a plurality of spray nozzles, one of which is shown at 54, are positioned to spray fluid additive generally at rotor 24. Spray nozzle 54, visible in FIG. 1, defines a spray axis 42, and at the operating position of spray bar assembly 40 (and its spray bar to be described below) spray axis 42 is oriented to intersect rotor 24. Spray bar assembly 40 is adjustable from the operating position to a tilted position, or an otherwise disengaged position, for accessing and servicing spray nozzle 54 and the rest of the plurality of spray nozzles, as further discussed herein. Rather than tilting, spray bar 50 could be lifted free of elongate carrier 76, slid relative of elongate carrier 76, or manipulated still another way to position spray nozzles 54 where they can be accessed for service. As will be further apparent from the following description, spray bar assembly 40 is uniquely configured to enable accessing its components from a position beside machine frame 12 and/or housing 22. Adjustment of spray bar assembly 40 in this general manner occurs by way of rotation of components about a hinge axis 44 as further discussed herein.

Figure 2:
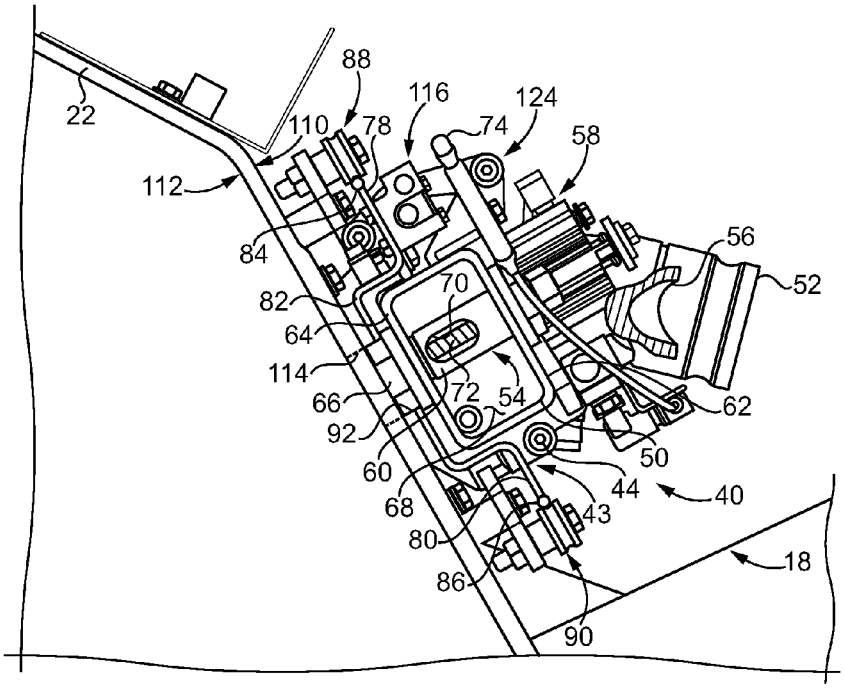
FIG. 2 is a partially sectioned side diagrammatic view of a spray bar assembly in a material working system of the machine of FIG. 1, in an operating position.

Referring now also to FIG. 2, there is shown a sectioned view illustrating portions of material working system 18, including spray bar assembly 40 and housing 22, in more detail. Spray bar assembly 40 includes a spray bar 50, which can have an elongate beam or box construction, and has a fluid inlet 52 formed therein. Fluid inlet 52 is shown at a location of a fitting attached to the spray bar proper that will be understood to fluidly connect with pump 38, to convey pumped fluid, such as an asphalt emulsion, into an internal cavity 68 defined by spray bar 50. Internal cavity 68 is in fluid communication with fluid inlet 52. Spray bar 50 also includes a fluid outlet 56 in fluid communication with internal cavity 68, such that fluid additive can be circulated through spray bar 50, as well as being applied by spraying into a material working cavity 96 formed in housing 22, as further discussed herein.

Spray bar 50 further includes a plurality of spray nozzles 54 in a plurality of nozzle assemblies 58. Each spray nozzle 54 includes a nozzle body 60 having a nozzle tip 66. In an implementation, spray bar 50 includes an upper side 62, and a lower side 64 facing an elongate carrier 76 further discussed herein. The plurality of spray nozzles 54 extend through spray bar 50 and each have the corresponding spray nozzle tip 66 positioned to extend from lower side 64. Spray nozzles 54 are each in fluid communication with fluid inlet 52 by way of an orifice 70 formed in the corresponding nozzle body 60 and by way of internal cavity 68. A valve 72 may be positioned at least partially within each nozzle body 60 and structured to control starting and stopping spraying the fluid additive out of the corresponding nozzle tip 66. Each of the plurality of spray nozzles 54 can be pneumatically operated, or operated by another suitable actuation method. Pneumatic supply equipment 74 of generally conventional design may be included in spray bar assembly 40 for operating valves 72.

Spray bar assembly 40 further includes elongate carrier 76 as noted above. Elongate carrier 76 may extend in longitudinal alignment with spray bar 50, and is coupled to spray bar 50 by way of a hinge connector 43 that defines hinge axis 44. Hinge connector 43 can include or be part of a plurality of hinge connectors spaced longitudinally along spray bar 50 and elongate carrier 76. Elongate carrier 76 includes a first or forward support element 84 and a second or back support element 86, for supporting elongate carrier 76 between a first or forward guide element 88 and a second or back guide element 90. Additional support elements and additional guide elements can be provided, as shown in the drawings. Guide element 88 and guide element 90 may be mounted at fixed locations to, for example, housing 22, of ground-engaging machine 10, such that spray bar assembly 40 is guided for linear movement relative to ground-engaging machine 10.

In an implementation, the coupling of support elements 84 and 86 with guide elements 88 and 90 can include a rail-upon-roller design. One of support element 84 and guide element 88 can include a rail, and the other of support element 84 and guide element 88 can include a roller. Analogously, one of support element 86 and guide element 90 can include a rail, and the other of support element 86 and guide element 90 can include a roller. In the illustrated embodiment, forward support element 84 and back support element 86 include a forward rail and a back rail, respectively. Guide element 88 and guide element 90 include a forward roller and a back roller, respectively. It should also be appreciated that multiple rollers might be used, although only single rollers at the guide element locations are visible in the illustration of FIG. 2.

It can further be seen from FIG. 2 that elongate carrier 76 has a non-uniform profile formed by a raised forward section 78, a raised back section 80, and an indented middle section 82. In alternative embodiments, elongate carrier could be a simple plate, have a profile that is a mirror image of the profile shown, or another design altogether. Elongate carrier 76 further has at least one opening 92 formed therein and located between forward support element 84 and back support element 86. Spray bar 50 is rotatable about hinge axis 44 relative to elongate carrier 76 between a tilted position, and an operating position. At the operating position the plurality of spray nozzles 54, namely, nozzle tips 66, extend through the at least one opening 92. It will further be appreciated that the at least one opening includes a plurality of openings 92 in register with the plurality of spray nozzles 54. The plurality of openings 92 can be formed in middle section 82, and may be regularly spaced circular openings, or openings of another arrangement and/or design.

Figure 3:
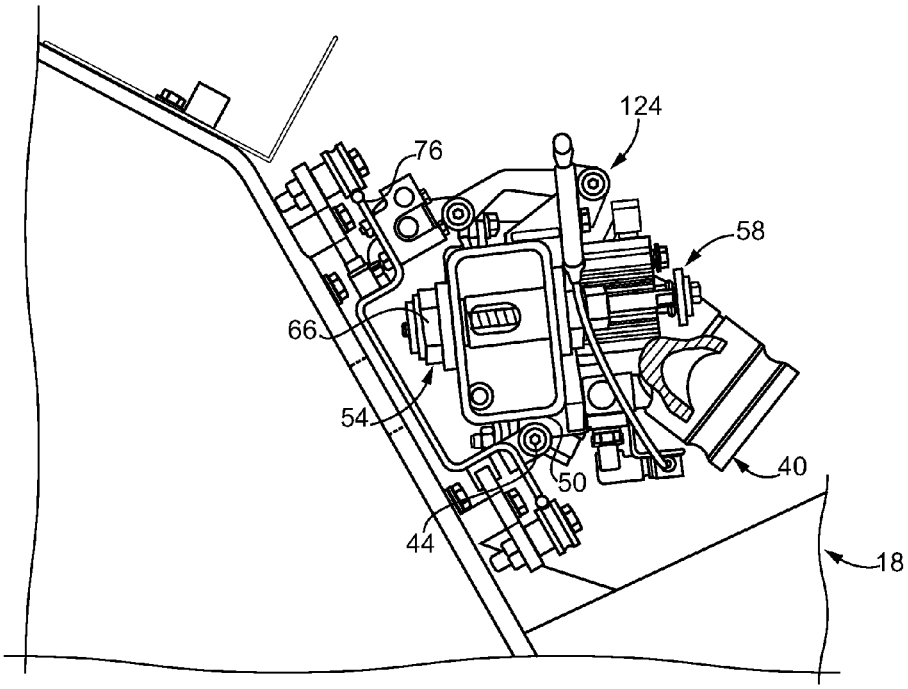
FIG. 3 is a partially sectioned side view of the spray bar assembly of FIG. 2, in a disengaged position.
Figure 4:
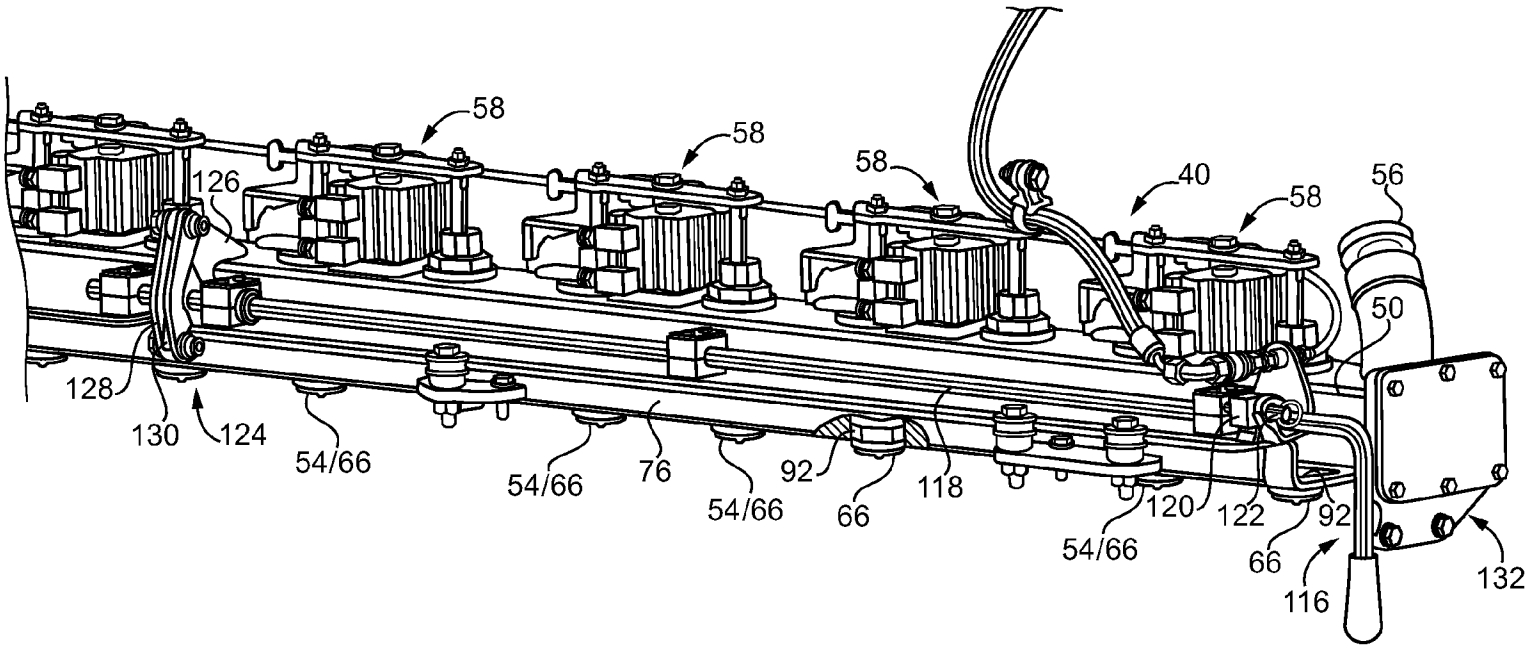
FIG. 4 is a perspective view of a spray bar assembly as in FIG. 2 and FIG. 3.

Referring now to FIG. 3, there is shown spray bar assembly 40 as it might appear where spray bar 50 has been rotated about hinge axis 44 to its tilted position. Spray bar assembly 40 can further include a linkage 124 controlling rotation of spray bar 50. Spray bar 50 might be rotated about hinge axis 44 in an angular range that is less than 90 degrees, more particularly and typically less than 45 degrees, and in the illustrated embodiment about 30 degrees, although the present disclosure is not thereby limited. Referring also now to FIG. 4, there is shown another view of spray bar assembly 40, illustrating the plurality of spray nozzles 54 and spray nozzle tips 66 spaced longitudinally along a length of spray bar 50. A first set of the plurality of spray orifices 54 may be located upon a first longitudinal side of linkage 124, and a second set of the plurality of spray nozzles 54 being located upon a second longitudinal side of linkage 124. Linkage 124 may be positioned approximately at a longitudinal half-way location of spray bar assembly 40, although the present disclosure is not thereby limited. FIG. 4 illustrates spray bar assembly 40 as it might appear where spray bar 50 is at the operating position, with each of spray nozzles 54 extending through the plurality of openings 92. Also shown in FIG. 4 are additional features of linkage 124, including a first link bar 126 attached to spray bar 50, a second or connecting link bar 128, and a third link bar 130 attached to elongate carrier 76. It should be appreciated that a great many different linkage designs, or no linkage at all, could be employed within the context of the present disclosure. Linkage 124 can limit angular rotation of spray bar 50 such that an operator or a technician can manually rotate spray bar 50 between the operating position and the tilted position, within the angular range defined by linkage 124. FIG. 4 also illustrates an end plate 132 attached to spray bar 50 that is not shown in the sectioned views of FIG. 2 and FIG. 3, and a locking mechanism 116. Locking mechanism 116 can have a locked state, and an unlocked state to permit rotating spray bar 50 between the tilted position and the operating position. In the illustrated embodiment locking mechanism 116 can lock spray bar 50 at each of the operating position and at the tilted position, and can also be used to manually rotate spray bar 50 to the tilted position. A pin 122 can be inserted or withdrawn into or out of a block 120 positioned upon a control rod 118 that is coupled with linkage 124. Control rod 118 can be rotated to rotate linkage 124 and controllably tilt spray bar 50 from the operating position to the tilted position. With pin 122 inserted into block 120 rotation of control rod 118 is inhibited. With pin 122 withdrawn, control rod 118 can be rotated. Block 120 could be equipped with a first hole (not shown) that receives pin 122 when spray bar 50 is at the operating position, and a second hole (not shown) that receives pin 122 when spray bar 50 is at the tilted position.

Figure 5:
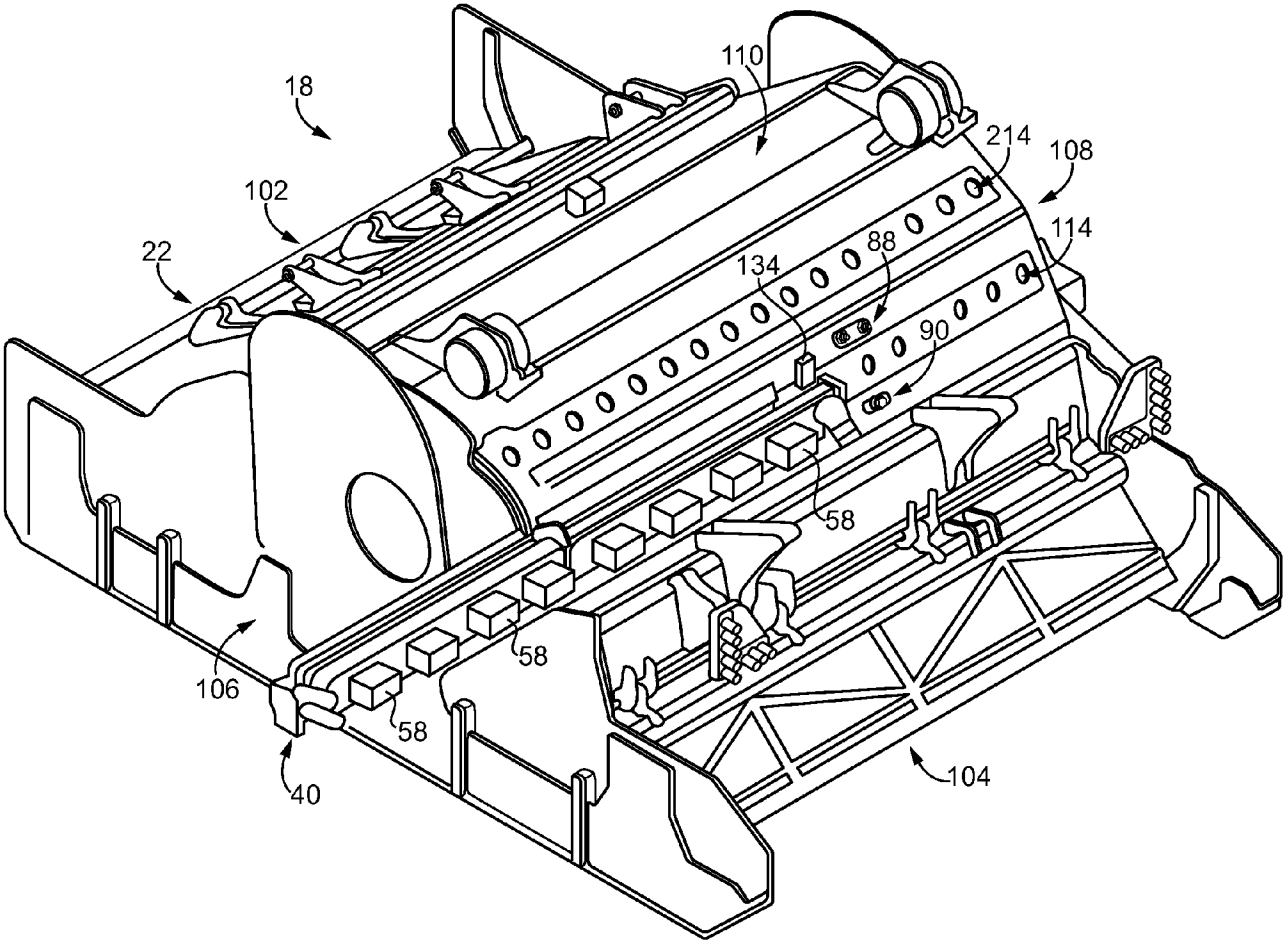
FIG. 5 is a perspective view of a material working system suitable for use in the machine of FIG. 1, including a spray bar assembly at an outboard position.
Figure 6:
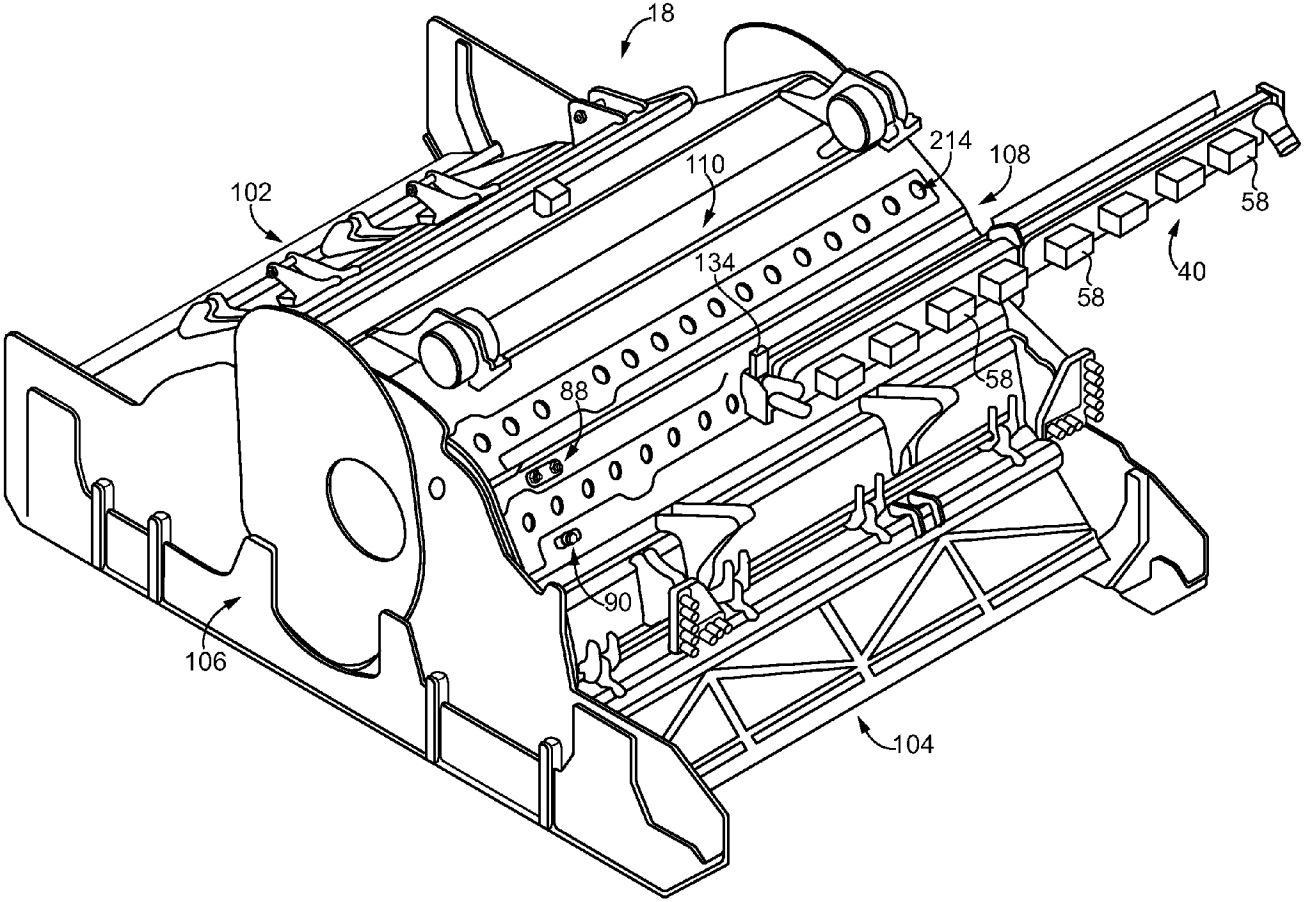
FIG. 6 is a perspective view of the material working system of FIG. 5, with the spray bar assembly at a second outboard position.

Turning now to FIG. 5, there is shown spray bar assembly 40 coupled with housing 22 and shown as it might appear at a left lateral stop position or first outboard position, where spray bar assembly 40 contacts a stop 134, and at least some of spray nozzles 54 are positioned outboard of housing 22. It will be recalled that support elements 84 and 86 and guide elements 88 and 90 guide spray bar assembly 40 for linear movement, and would be understood to guide spray bar assembly 40 from an inboard position at which spray bar assembly 40 is positioned inboard of a left lateral edge 106 and a right lateral edge 108 of housing 22, and the outboard position depicted in FIG. 5. Referring also to FIG. 6, there is shown spray bar assembly 40 as it might appear having been slid to a right lateral stop position or second outboard position, again with at least some of spray nozzles 54 positioned outboard of a right lateral edge 108 of housing 22. Spray bar assembly 40 contacts a stop 134, which can be the same stop contacted at the left outboard position, in FIG. 6, or a different stop.

It can also be noted from FIGS. 5 and 6, and elsewhere in the drawings, that housing 22 has a plurality of spray ports 114 formed therein that communicate between an outer surface 110 and an inner surface 112 of housing 22 shown in FIG. 2. At the operating position of spray bar 50, spray nozzles 54 extend through elongate carrier 76 and are within and/or in alignment with spray ports 114. Spray ports 114 may have a longitudinal distribution across a width of housing 22. In an implementation, openings 92, spray ports 114, and spray nozzles 54 have matched distributions within elongate carrier 76, housing 22, and spray bar 50, respectively. It can therefore be appreciated that linearly adjusting spray bar assembly 40 enables spray nozzles 54, openings 92, and spray ports 114 to be positioned in register with one another, or slid such that those features are not in register with one another. In FIG. 5 and FIG. 6 a plurality of additional spray ports 214 are shown in housing 22, and could be associated with a second spray bar assembly (not shown) structured to spray the same fluid additive, or potentially a different fluid additive, as that of spray bar assembly 40. It will be noted that outer surface 110 extends fore to aft between a leading edge 102 and a trailing edge 104 and laterally between left lateral edge 106 and right lateral edge 108. Spray ports 214 include a lateral distribution at a location that is forward of spray ports 114. Spray ports 114 can also be seen to have a slightly different orientation than spray ports 214 toward a location that would be occupied by rotor 24, such that spray bar assemblies associated with the respective sets of spray ports 114, 214 could be associated with spray nozzles having differently oriented spray axes. Still further possible variations on the numbers and arrangements of spray ports and spray bars will be apparent to those skilled in the art.

INDUSTRIAL APPLICABILITY

Referring to the drawings generally, during operation of machine 10, machine 10 can be driven in a forward travel direction across a substrate, with material working mechanism 20 lowered to a working depth to enable rotor 24 to break apart the substrate and mix the substrate with an underlying material such as soil. Rotor 24 will generally counter-rotate relative to a machine travel direction, at a speed that can be varied relative to a ground speed of machine 10. System 30 can be operated to deliver fluid additive continuously or periodically by operating pump 38 to convey fluid additive from reservoir 32 into spray bar 50, with spray nozzles 54 operated selectively to spray the fluid additive at rotor 24, or otherwise into material working chamber 96.

When machine 10 is taken out of service in the course of a day's work or when transported offsite to a service center or the like, it may be desirable to inspect, clean, replace, or otherwise service spray nozzles 54. In a typical implementation, when machine 10 is removed from service system 30 can be operated to purge line 34 and line 36 as well as spray bar 50 and spray nozzles 54 with water or another purging fluid. It is nevertheless anticipated that at least periodically spray nozzles 54 will need to be manually serviced. In such case, spray bar 50 can be rotated between the operating position and the tilted position relative to elongate carrier 76 by rotating spray bar 50 about hinge axis 44. Spray nozzles 54 can be moved between a first orientation, approximately as depicted in FIG. 2, where spray nozzles 54 are in fluid communication with material working chamber 96, and a second orientation at the tilted position, approximately as shown in FIG. 3. With spray bar 50 tilted, and spray nozzles 54 withdrawn from spray ports 114 and openings 92, spray bar 50 and elongate carrier 76 can be slid laterally with respect to machine 10 and/or housing 22 between an inboard position where spray nozzles 54 are positioned inboard of lateral edges 106 and 108, and a lateral stop position as described herein where at least some of spray nozzles 54 are positioned outboard of housing 22. The sliding of spray bar 50 and elongate carrier 76 is guided by way of contact between support element 84 and support element 86 and guide element 88 and guide element 90, respectively. A lateral stop position could be either of the left lateral stop position shown in FIG. 5 or the right lateral stop position shown in FIG. 6.

It can further be noted that spray bar 50 can be understood to have a left half and a right half. Sliding spray bar assembly 40 to a left lateral stop position can allow spray nozzles 54 associated with the left half of spray bar assembly 40 to be serviced, whereas sliding spray bar assembly 40 to the right lateral stop position can enable servicing of spray nozzles 54 associated with the right half of spray bar 50. When servicing is complete, spray bar assembly 40 can be slid back to an inboard position, and spray bar 50 rotated back to the operating position. Transitioning spray bar 50 between the operating position and the tilted position can include passing spray nozzles 54 through spray ports 114 formed in housing 22 as well as openings 92 formed in elongate carrier 76. Locking mechanism 116 and linkage 124 can be operated in the manner described herein to assist in and enable the transitioning of spray bar 50 between the operating position and the tilted position. When spray bar 50 is in the operating position, positioning of spray nozzles 54 within the registering openings 92 and spray ports 114 can resist laterally displacing spray bar assembly during operation. Positioning of end plate 132 and an opposite end plate (not shown), adjacent to left lateral edge 106 and right lateral edge 108 of housing 22, respectively, can resist laterally displacing spray bar assembly 40 during service.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A spray bar assembly for a ground-engaging machine comprising:

a spray bar having a fluid inlet formed therein, and a plurality of spray nozzles in fluid communication with the fluid inlet;

a hinge connector defining a hinge axis;

an elongate carrier coupled to the spray bar by way of the hinge connector and extending in longitudinal alignment with the spray bar;

the elongate carrier having a forward support element and a back support element for supporting the elongate carrier between guide elements mounted to the ground-engaging machine, such that the spray bar assembly is guided for linear movement relative to the ground-engaging machine; and the elongate carrier further having at least one opening formed therein between the forward support element and the back support element, and the spray bar being rotatable about the hinge axis relative to the elongate carrier between a tilted position, and an operating position, and the plurality of spray nozzles each extending through the at least one opening at the operating position.

2. The spray bar assembly of claim 1 wherein the at least one opening includes a plurality of openings in register with the plurality of spray nozzles.

3. The spray bar assembly of claim 2 wherein the forward support element and the back support element include a forward rail and a back rail, respectively.

4. The spray bar assembly of claim 2 wherein the elongate carrier has a non-uniform profile formed by a raised forward section, a raised back section, and an indented middle section, and the plurality of openings are formed in the middle section.

5. The spray bar assembly of claim 4 further comprising a linkage coupling the spray bar to the elongate carrier, and a locking mechanism coupled with the linkage and adjustable between a locked state and an unlocked state to permit rotating the spray bar between the tilted position and the operating position.

6. The spray bar assembly of claim 5 wherein a first set of the plurality of spray nozzles is located upon a first longitudinal side of the linkage, and a second set of the plurality of spray nozzles is located upon a second longitudinal side of the linkage.

7. The spray bar assembly of claim 2 wherein the spray bar defines an internal cavity in fluid communication with the fluid inlet, and each of the plurality of nozzles includes a nozzle body extending through the internal cavity and having an orifice in fluid communication with the internal cavity.

8. A machine system comprising:

a housing positionable about a material working mechanism of a ground-engaging machine, the housing having an inner surface, and an outer surface extending fore to aft between a leading edge and a trailing edge, and laterally between a left lateral edge and a right lateral edge;

a spray bar assembly mounted to the housing and including a spray bar having a fluid inlet structured to connect with a fluid reservoir, and an elongate carrier coupled to the spray bar, the elongate carrier supporting the spray bar and configured to allow the spray bar to move linearly relative to the housing;

the spray bar including a plurality of spray nozzles in fluid communication with the fluid inlet; and the housing further having a plurality of spray ports formed therein extending between the outer surface and the inner surface, and the spray bar being movable between a disengaged position to allow linear movement of the spray bar relative to the housing, and an operating position at which the plurality of spray nozzles are aligned with the plurality of spray ports.

9. The machine system of claim 8 wherein the elongate carrier is linearly movable between a first lateral stop position at which at least some of the plurality of spray nozzles are positioned outboard of the left lateral edge of the housing, and a second lateral stop position at which at least some of the plurality of spray nozzles are positioned outboard of the right lateral edge of the housing.

10. The machine system of claim 8 wherein the elongate carrier includes a plurality of openings formed therein, and the plurality of openings, the plurality of spray ports, and the plurality of spray nozzles have matched distributions within the elongate carrier, the housing, and the spray bar, respectively.

11. The machine system of claim 8 further comprising a forward guide element and a back guide element mounted at fixed locations upon the housing, and wherein the spray bar further includes a forward support element and a back support element, coupled with the forward guide element and the back guide element, respectively.

12. The machine system of claim 11 wherein the forward support element includes a forward rail, and the back support element includes a back rail.

13. The machine system of claim 12 wherein the forward guide element includes a forward roller, and the back guide element includes a back roller.

14. The machine system of claim 8 wherein the spray bar includes an upper side, and a lower side facing the elongate carrier, and wherein the plurality of spray nozzles extend through the spray bar and each include a spray nozzle tip extending from the lower side.

15. The machine system of claim 14 wherein each of the plurality of spray nozzles defines a spray axis, and the machine system further includes a ground-engaging rotor within the housing and positioned such that the rotor is intersected by the spray axis of the plurality of spray nozzles at the operating position.

16. The machine system of claim 15 wherein the housing defines a rotor chamber, and the spray nozzle tips are positioned at least partially within the rotor chamber at the operating position.

17. A method of operating a spray bar assembly in a ground-engaging machine comprising:

rotating a spray bar between an operating position and a tilted position relative to an elongate carrier coupled to the spray bar by way of a hinge connector;

moving a plurality of spray nozzles of the spray bar between a first orientation at the operating position, where the plurality of spray nozzles are in fluid communication with a material working chamber in the ground-engaging machine, and a second orientation at the tilted position; and sliding the spray bar and elongate carrier laterally with respect to the ground-engaging machine between an inboard position where the plurality of spray nozzles are positioned inboard of lateral edges of a housing forming the material working chamber, and a lateral stop position where at least some of the plurality of spray nozzles are positioned outboard of the housing.

18. The method of claim 17 wherein the sliding of the spray bar laterally with respect to the ground-engaging machine further includes guiding the sliding of the spray bar by way of contact between a rail on one of the elongate carrier and the housing and a roller on the other of the elongate carrier and the housing.

19. The method of claim 18 further comprising passing the plurality of spray nozzles through a plurality of spray ports formed in the housing and a plurality of openings formed in the elongate carrier and in register with the plurality of spray ports during the moving of the plurality of spray nozzles.

20. The method of claim 17 wherein spray axes of the plurality of spray nozzles are oriented so as to intersect a rotor within the material working chamber at the first orientation.

* * * * *